US012765591B2

(12) United States Patent
Howard et al.

(10) Patent No.: US 12,765,591 B2
(45) Date of Patent: Oct. 20, 2026

(54) CARTOMISER

(71) Applicant: NICOVENTURES TRADING LIMITED, London (GB)

(72) Inventors: Matthew Howard, London (GB); David Bishop, London (GB); David Rushforth, London (GB); Charanjit Nandra, London (GB)

(73) Assignee: NICOVENTURES TRADING LIMITED, London (GB)

( * ) Notice: Subject to any disclaimer, the term of this patent is extended or adjusted under 35 U.S.C. 154(b) by 914 days.

(21) Appl. No.: 17/283,010

(22) PCT Filed: Oct. 4, 2019

(86) PCT No.: PCT/GB2019/052804
§ 371 (c)(1),
(2) Date: Apr. 5, 2021

(87) PCT Pub. No.: WO2020/070513
PCT Pub. Date: Apr. 9, 2020

(65) Prior Publication Data

US 2021/0345665 A1 Nov. 11, 2021

(30) Foreign Application Priority Data

Oct. 5, 2018 (GB) ..... 1816267

(51) Int. Cl.
*A24F 40/10* (2020.01)
*A24F 40/20* (2020.01)
(Continued)

(52) U.S. Cl.
CPC ..... *A24F 40/30* (2020.01); *A24F 40/10* (2020.01); *A24F 40/20* (2020.01); *A24F 40/42* (2020.01)

(58) Field of Classification Search
CPC ..... A24F 40/10; A24F 40/20; A24F 40/30; A24F 40/42
See application file for complete search history.

(56) References Cited

U.S. PATENT DOCUMENTS 9,936,731 B2 4/2018 Hopps
2004/0011369 A1* 1/2004 Matsufuji ..... A24D 1/025 131/365

(Continued)

FOREIGN PATENT DOCUMENTS

WO WO2015189556 12/2015
WO WO-2016042101 A1 * 3/2016 ..... A24C 5/00

(Continued)

OTHER PUBLICATIONS

National Center for Biotechnology Information. "PubChem Compound Summary for CID 753, Glycerin" PubChem, https://pubchem.ncbi.nlm.nih.gov/compound/Glycerin. Accessed Apr. 30, 2024. (Year: 2024).*

(Continued)

*Primary Examiner* — Katherine A Will
(74) *Attorney, Agent, or Firm* — Womble Bond Dickinson (US) LLP; Mark R. DeLuca

(57) ABSTRACT

The present disclosure relates to a cartomiser for a vapour provision system configured to selectively generate vapours with different flavour characteristics. Also disclosed is a vapour provision system comprising said cartomiser and a method of operating the vapour provision system. The flavour characteristics may be used to provide an end-of-life indication to a user.

13 Claims, 3 Drawing Sheets

(51) Int. Cl.
*A24F 40/30* (2020.01)
*A24F 40/42* (2020.01)

(56) References Cited

U.S. PATENT DOCUMENTS

| | | | | |
|---|---|---|---|---|
| 2008/0092912 | A1* | 4/2008 | Robinson | H05B 3/42 131/200 |
| 2016/0262454 | A1 | 9/2016 | Sears et al. | |
| 2017/0157341 | A1 | 6/2017 | Pandya et al. | |
| 2017/0238600 | A1* | 8/2017 | Grant | A24C 5/35 |
| 2018/0310608 | A1* | 11/2018 | Sciboz | A24B 15/14 |
| 2018/0343917 | A1* | 12/2018 | Sutton | A24F 40/42 |
| 2019/0124982 | A1* | 5/2019 | Atkins | A61M 15/06 |
| 2020/0037667 | A1* | 2/2020 | Woodcock | A24F 40/53 |

FOREIGN PATENT DOCUMENTS

| | | | | |
|---|---|---|---|---|
| WO | WO-2016156495 | A2 * | 10/2016 | A24B 15/167 |
| WO | WO-2017077110 | A1 * | 5/2017 | A24B 15/12 |
| WO | WO-2017185051 | A1 * | 10/2017 | A24F 40/30 |
| WO | WO2018146453 | | 8/2018 | |

OTHER PUBLICATIONS

International Search Report and Written Opinion for International Application PCT/GB2019/052804 date mailed Dec. 16, 2019.
International Preliminary Report on Patentability for International Application PCT/GB2019/052804 date mailed Jun. 30, 2020.

* cited by examiner

CARTOMISER

PRIORITY CLAIM

The present application is a National Phase entry of PCT Application No. PCT/GB2019/052804, filed Oct. 4, 2019 which claims priority from GB Patent Application No. 1816267.7 filed Oct. 5, 2018, each of which is hereby fully incorporated herein by reference.

FIELD OF THE INVENTION

The present disclosure relates to a cartomizer for a vapor provision system such as a cartridge for a nicotine delivery system, electronic cigarettes or the like, a vapor provision system comprising the cartomizer, and use of a first and second vapor precursor material respectively having a first and a second flavor characteristic, to provide different flavor characteristics to a user of a vapor provision system. In particular, the present disclosure relates to the use of the first and second vapor precursor material to provide an end-of-life tobacco flavor to a user.

BACKGROUND TO THE INVENTION

Electronic vapor provision systems such as electronic cigarettes (e-cigarettes) generally contain a cartomizer with a reservoir of a liquid containing a formulation, typically including nicotine and often flavorants or flavoring agents, and/or a solid material such as a tobacco-based product, from which vapor is generated for inhalation by a user, for example through heat vaporization.

Thus, a vapor provision system will typically comprise a cartomizer with a vaporizer, e.g. a heating element, arranged to vaporize a portion of precursor material to generate vapor in a vapor generation chamber. As a user inhales on the system or device and electrical power is supplied to the vaporizer, air is drawn into the device through inlet holes and into the vapor generation chamber where the air mixes with the vaporized precursor material. There is typically a flow path connecting the vapor generation chamber with an opening in the mouthpiece of the device so that incoming air drawn through the vapor generation chamber continues along the flow path to the mouthpiece opening, carrying some of the vapor with it, and out through the mouthpiece opening for inhalation by the user.

Vapor provision systems may comprise a modular assembly including both reusable and replaceable cartridges or cartomizers. Typically a cartridge will comprise the consumable vapor precursor material and/or the vaporizer, while a reusable device part will comprise longer-life items, such as a rechargeable battery, device control circuitry, activation sensors and user interface features. The reusable part may also be referred to as a control unit or battery section, and replaceable cartridges that include both a vaporizer and precursor material may also be referred to as cartomizers.

Cartridges or cartomizers are electrically and mechanically coupled to a control unit for use, for example, using a screw thread or bayonet fixing with appropriately engaging electrical contacts. When the vapor precursor material in a cartridge is exhausted, or the user wishes to switch to a different cartridge having a different vapor precursor material, a cartridge may be removed from the control unit and a replacement cartridge attached in its place. Alternatively, the removed cartridge may be refilled before reattachment to the control unit.

A vapor provision system may be configured to issue user notifications, for example, a vapor provision system may comprise a controller configured to monitor an operating state for the system and to determine when a particular operating condition arises and provide a user notification in response thereto. For example, a vapor provision system may be configured to provide a user with a warning when a remaining amount of power or charge in a battery or a remaining amount of vapor precursor material in a cartridge falls below a threshold level. These kinds of user notifications are often provided using an indicator light, such as a light emitting diode, mounted on the device.

SUMMARY OF THE INVENTION

According to a first aspect of the invention, there is provided a cartomizer for a vapor provision system configured to selectively generate vapors with different flavor characteristics, wherein the cartomizer comprises: (i) a reservoir comprising a first vapor precursor material having a first flavor characteristic, and a second vapor precursor material having a second flavor characteristic; and (ii) at least one vaporizer for generating vapor from the first vapor precursor material and the second vapor precursor material; wherein the first vapor precursor material and the second vapor precursor material are configured to form an inhomogeneous mixture within the reservoir; wherein the first vapor precursor material is configured to provide vapor with the first flavor characteristic; and wherein the second vapor precursor material is configured to provide vapor with the second flavor characteristic, wherein the second flavor characteristic is different from the first flavor characteristic.

According to a further aspect of the invention, there is provided a vapor provision system comprising the cartomizer defined herein.

According to another further aspect of the invention, there is provided a use of a first vapor precursor material and a second vapor precursor material in a vapor provision system, to provide an end-of-life flavor; wherein the first and second vapor precursor materials form an inhomogeneous mixture; wherein the first vapor precursor material is configured to provide vapor with a first flavor characteristic; wherein the second vapor precursor material is configured to provide vapor with a second flavor characteristic that is different from the first flavor characteristic; wherein the second vapor precursor material is configured to provide vapor after at least a substantial portion of the first vapor precursor material has been vaporized, and wherein the second flavor characteristic of the second vapor precursor material comprises a tobacco flavor.

According to another further aspect of the invention, there is provided a method of operating a vapor provision system configured to selectively generate vapors with different flavor characteristics for inhalation by a user, wherein the method comprises generating a vapor from a first vapor precursor material having a first flavor characteristic, and generating a vapor from a second vapor precursor material having a second flavor characteristic that is different from the first flavor characteristic, wherein the first vapor precursor material and the second vapor precursor material are inhomogeneous, and wherein the second vapor precursor material is configured to provide vapor after at least a portion of the first vapor precursor material has been vaporized.

According to another further aspect of the invention, there is provided a method of operating a vapor provision system configured to selectively generate vapors with different flavor characteristics for inhalation by a user, wherein the method comprises generating a vapor from a first vapor precursor material having a first flavor characteristic, and generating a vapor from a second vapor precursor material having a second flavor characteristic that is different from the first flavor characteristic, wherein the first vapor precursor material and the second vapor precursor material are inhomogeneous, and wherein the second vapor precursor material is configured to provide vapor with the second flavor characteristic in response to a user action on the vapor provision system.

These and further aspects of the invention are set out in the appended independent and dependent claims. It will be appreciated that features of the dependent claims may be combined with each other and with features of the independent claims in combinations other than those explicitly set out in the claims. Furthermore, the approaches described herein are not restricted to specific embodiments such as those set out below, but include and contemplate any appropriate combinations of features presented herein. For example, a cartomizer may be provided in accordance with approaches described herein which includes any one or more of the various features described below as appropriate.

BRIEF DESCRIPTION OF THE DRAWINGS

Embodiments will now be described, by way of example only, with reference to the accompanying drawings, in which:

FIG. 1 shows the first vapor precursor material 3 as being in contact with the vaporizer (4, 5) and the second vapor precursor material 2 atop the first vapor precursor material.

In FIG. 2, the first vapor precursor material 3 is depleted and the second vapor precursor material is in contact with the vaporizer (4, 5).

In FIG. 3, the first vapor precursor material 3 is a different state of matter to the second vapor precursor material 2. In the embodiment shown in FIG. 3, the first vapor precursor material is a liquid and the second vapor precursor material is a solid.

Figure 1:
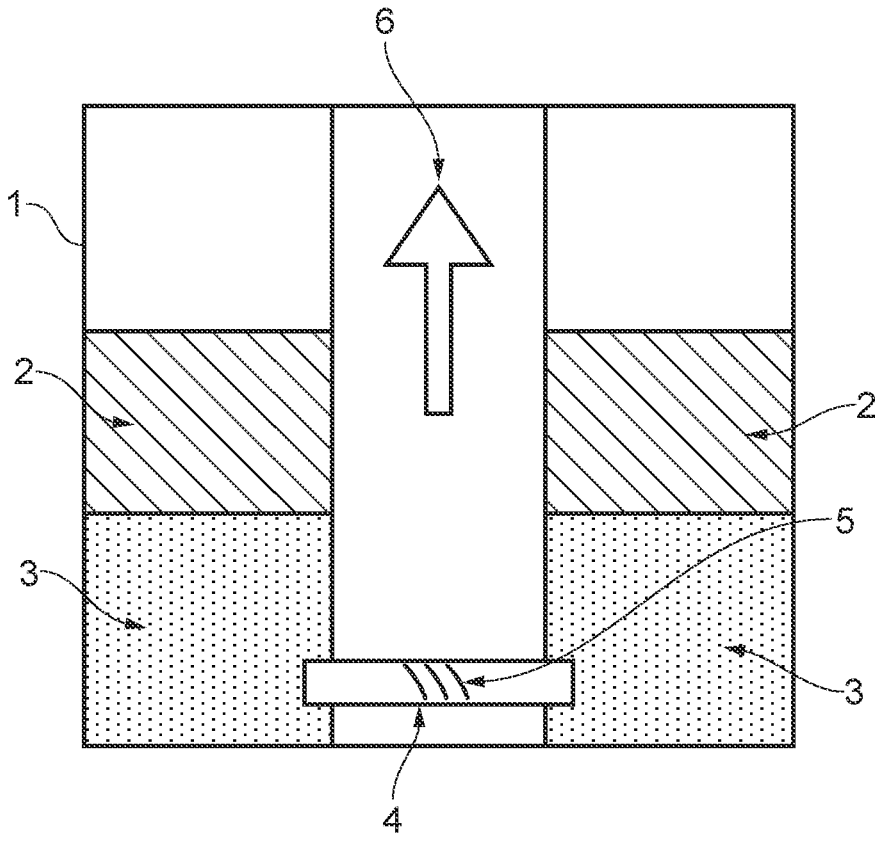
FIG. 1 is a highly schematic cross-section of a cartomizer in accordance with certain embodiments of the disclosure. As is discussed in more detail below.
Figure 2:
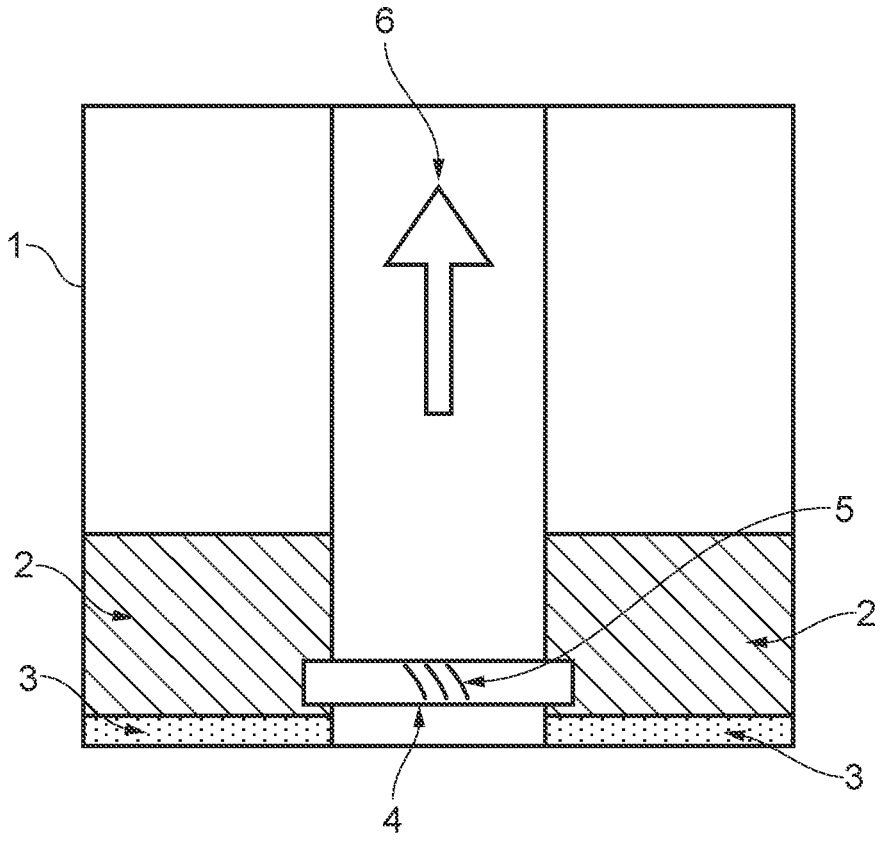
FIG. 2 is a highly schematic cross-section of a cartomizer in accordance with certain embodiments of the disclosure.
Figure 3:
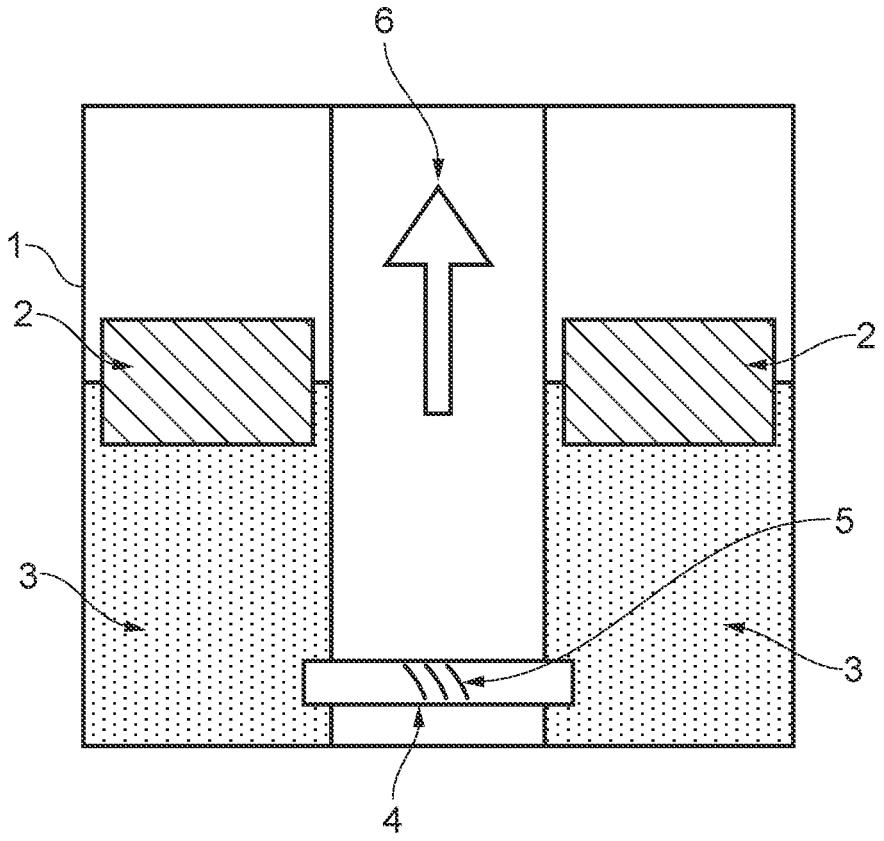
FIG. 3 is a highly schematic cross-section of a cartomizer in accordance with certain embodiments of the disclosure.

It will be appreciated by the person skilled in the art that none of FIGS. 1 to 3 are drawn to scale.

DETAILED DESCRIPTION

Aspects and features of certain examples and embodiments are discussed and described herein. Some aspects and features of certain examples and embodiments may be implemented conventionally and these are not discussed or described in detail in the interests of brevity. It will thus be appreciated that aspects and features of apparatus and methods discussed herein which are not described in detail may be implemented in accordance with any conventional techniques for implementing such aspects and features.

As discussed herein, the present invention provides a cartomizer and a vapor provision system comprising the cartomizer which is able to provide different flavor characteristics to a user. Such flavor characteristics can include an end-of-life flavor, whether in the form of a tobacco flavor or non-tobacco flavor. These flavor characteristics can be provided without user involvement and provide a straightforward yet advantageous approach to improving user experience.

In arriving at the present invention, the inventors recognized that the known approaches for providing user notifications in vapor provision systems can have some drawbacks. For example, the provision of an indicator light can increase manufacturing complexity and associated costs, and requires visual attention from users. In addition, known approaches for providing user notification of a cartridge needing replacement can often be accompanied by an unpleasant or undesirable flavor due to the vapor precursor material reaching a critical level in the reservoir. Accordingly there is a desire for alternative schemes for providing user notifications in vapor provision systems, and specifically a desire for vapor provision systems to be able to provide an "end-of-life" notification to a user without relying on visual attention from users.

The inventors further recognized that vapor provision systems containing a solid tobacco product and a liquid have drawbacks in terms of flavor loss when the cartridge or cartomizer needs replacing. In particular, when the solid tobacco product reaches exhaustion, the user experiences a loss of flavor therefrom. Accordingly there is a desire to provide an end-of-life tobacco flavor in a vapor provision system containing both a liquid formulation and a solid tobacco product or material.

Finally, there is a desire for alternative schemes for providing multiple flavors to a user. Known approaches for delivering multiple flavors include having multiple flavor-containing reservoirs in a cartridge, optionally with user control of the end flavor which is inhaled. Such approaches are, however, complex in terms of manufacture and require user involvement in order to deliver a particular flavor profile.

As well as providing an end-of-life flavor without requiring user involvement, the present invention is able to compensate for the loss of flavor in a hybrid device, and also provides a cartomizer and a vapor provision system comprising the cartomizer which can be easily implemented by a user to provide a boost or burst of flavor. Specifically the present inventors found that these advantages can be achieved by incorporating a first vapor precursor material having a first flavor characteristic and a second vapor precursor material having a second flavor characteristic into a reservoir of a cartomizer, where the vapor precursor materials are configured such that they form an inhomogeneous mixture in the reservoir, and where the second flavor characteristic is different from the first flavor characteristic.

For ease of reference, these and further aspects of the present invention are now discussed under appropriate section headings. However, the teachings under each section are not necessarily limited to the section in which they are found.

Cartomizer

The present disclosure relates to cartomizers. As is known in the art, cartomizers are also referred to as cartridges. Throughout the following description the term "cartridge" may therefore be used interchangeably with "cartomizer".

FIGS. 1, 2 and 3 are schematic cross-sectional and perspective views of an example cartomizer according to some embodiments of the disclosure. The cartomizer includes a housing, which in this example is formed of a plastics material. The housing supports other components of the cartomizer and also provides a mechanical interface (not shown) for connecting the cartomizer with a control unit of a vapor provision system as required. The manner by which the cartomizer connects to the control unit is not significant for the invention described herein. It may, for example, comprise a screw thread fitting or any other attachment or connection means known to the person skilled in the art. The shape of the cartomizer housing is not limited and may be any shape known in the art.

The cartomizer housing includes the reservoir that contains the first vapor precursor material 3 having a first flavor characteristic and the second vapor precursor material 2 having the second flavor characteristic. The reservoir in the example shown in FIGS. 1, 2 and 3 comprises the majority of the interior volume of the cartomizer. Although not significant for the present invention, the reservoir may generally conform to the interior of the housing. In some examples, at least an outer wall of the reservoir may be integrally molded with the housing. In other examples, the reservoir may be a component which is formed separately from, but supported in position by, the housing. In examples, the reservoir may have a tapered circular cross-section but have a flat face running longitudinally along one side to create a space between an outer wall of the reservoir and an inner wall of the housing to define an air path through the cartomizer through which vapor generated in the cartomizer is drawn during use towards an opening in the end of the cartomizer. In other examples, the reservoir may have an annular shape, with the outer annular surface defined by the housing, and the inner annular surface defining an air path. It will be appreciated that there are many configurations which allow for the provision of a liquid reservoir alongside an air path within the cartomizer. The reservoir may be formed in accordance with conventional techniques, for example comprising a molded plastics material.

FIGS. 1, 2 and 3 show a wick 4 and a heater 5 as the vaporizer. Other known vaporizers may, however, be used. The wick and heater are arranged in a space within the cartomizer that defines a vaporization chamber 6 for the cartomizer 1. In this example the wick extends transversely across the vaporization chamber 6 with its ends extending into the reservoir of liquid, e.g. vapor precursor material, through openings in the inner wall of the reservoir. The openings in the inner wall of the reservoir are sized to broadly match the dimensions of the wick to provide a reasonable seal against leakage from the liquid reservoir into the cartridge air path without unduly compressing the wick, which may be detrimental to its fluid transfer performance. Vapor precursor material, e.g. liquid, may infiltrate the wick 4 through surface tension or capillary action.

In other examples the reservoir may comprise a porous ceramic disc (not shown) such that the liquid, e.g. vapor precursor materials, within the reservoir may seep through the ceramic disc. Adjacent the ceramic disc is then the wick of the vaporizer into which the liquid may infiltrate.

The heater 5 in FIGS. 1, 2 and 3 comprises an electrically resistive wire coiled around the wick 4 so that electrical power may be supplied to the heater 5 to vaporize an amount of vapor precursor material drawn to the vicinity of the heater 5 by the wick 4. The heater 5 may comprise a nickel chrome alloy (Cr20Ni80) wire and the wick 4 may comprise a glass fibre bundle, but it will be appreciated that the specific vaporizer configuration is not significant to the invention herein.

The rate at which vapor precursor material is vaporized by the vaporizer will depend on the amount of power supplied to the heater 5. Accordingly, electrical power can be applied to the heater to selectively generate vapor from the first and second vapor precursor material 2, 3 in the cartomizer 1, and furthermore, the rate of vapor generation can be controlled by adjusting the power supplied to the heater 5, for example through pulse width or frequency modulation techniques.

In FIG. 1, FIG. 2 and FIG. 3, the cartomizer includes a single vaporizer 4, 5 for generating vapor from both the first vapor precursor material 3 and the second vapor precursor material 2. In some embodiments the cartomizer includes more than one vaporizer, for example, a vaporizer for each vapor precursor material in the reservoir. In other embodiments the cartomizer includes a single vaporizer as shown in FIG. 1, FIG. 2 and FIG. 3.

Vapor Provision System

The present disclosure provides a vapor provision system comprising the cartomizer described herein. Vapor provision systems/devices may also be referred to herein as "aerosol provision systems/devices", "aerosol delivery devices/systems", "electronic vapor provision devices/systems", "electronic aerosol provision devices/systems" or "e-cigarettes/electronic cigarettes". These terms may be used interchangeably and are intended to include non-combustible aerosol and vapor provision systems/devices (non-combustible smoking articles) such as:

- electronic cigarettes or e-cigarettes that create vapor or aerosol from vapor precursor materials by heating or other techniques such as vibration,
- hybrid systems that provide vapor or aerosol via a combination of vapor precursor materials and solid substrate materials, for example hybrid systems containing liquid or gel vapor precursor materials and a solid substrate material.

As is common in the technical field, the terms "vapor" and "aerosol", and related terms such as "vaporize", "volatilize" and "aerosolize", may be used interchangeably herein.

Vapor precursor materials may also be referred herein as aerosol generating materials, vapor generating materials, aerosol precursor materials and substrate materials. The vapor precursor materials are materials that are capable of generating aerosol for example when heated, irradiated or energized in any other way. In general, the vapor precursor materials may be in the form of a solid, liquid or gel which may or may not contain nicotine and/or flavorantsants.

In some embodiments, the vapor provision system is a hybrid system for providing a vapor by heating, but not burning, a combination of vapor forming materials. The hybrid system comprises a cartomizer of the present invention and a substrate material. The substrate material may comprise for example solid, liquid or gel which may or may not contain nicotine. In some embodiments, the hybrid system comprises a cartomizer of the invention with the first and second vapor precursor materials and an (additional) solid substrate material. The solid substrate material may be, for example, a tobacco or non-tobacco product, which may or may not contain nicotine. In some embodiments, the hybrid system comprises the first and second vapor precursor materials which are liquid or gel, and a tobacco. The hybrid system also generally includes a control unit as described below.

In some embodiments, the vapor provision system is a non-combustible smoking article such as an electronic cigarette, also known as a vaping device. The vapor provision system comprises a cartomizer of the invention, as described herein, and generally a control unit.

The control unit comprises an outer housing, an electrical power source (e.g. a battery), control circuitry for controlling and monitoring the operation of the vapor provision system, a user input button, and a mouthpiece (which may be detachable). The battery may be rechargeable and be of a conventional type, for example of the kind typically used in electronic cigarettes and other applications requiring provision of relatively high currents over a relatively short period. Similarly, the user input button (or other vapor generation function) and control circuity may be conventional. The outer housing may be formed, for example, from a plastics or metallic material. Other suitable materials are known in the art.

As will be appreciated, the vapor provision system will in general comprise various other elements associated with its operating functionality. For example, a port for charging the battery, such as a USB port or the like, and these other elements may be conventional.

In some embodiments the control circuitry is configured to control the supply of electrical power from the battery to the vaporizer(s) in the cartomizer. For example, the vapor provision system may include the cartomizer with at least one reservoir and vaporizer as described herein, where the at least one vaporizer includes a heater supplied with power from the battery. Electrical power may be supplied to the respective heaters via contacts established across the interface between the cartomizer and the control unit, for example, through sprung/pogo pin connectors, or any other configuration of electrical contacts which engage when the cartomizer is connected to the control unit.

As noted above, the rate at which vapor precursor material is vaporized will depend on the amount of power supplied to the heater. Accordingly, the rate of vapor generation can be controlled by adjusting the power supplied to the heater, for example through pulse width or frequency modulation techniques. Regardless of how the electrical power, including the relative amount of power, to be delivered to the heaters in the cartomizers is configured, when the electronic cigarette is in its normal operating mode, a user may press the button to activate the heater in accordance with the configured relative power settings. Although a user button is described, it will be appreciated that the activation of vapor generation may be based on other techniques. For example, instead of using a button to activate the supply of power to the heaters, an inhalation sensor, for example, based around a pressure sensor/microphone arranged to detect a drop in pressure when a user inhales on the device, may be used.

When the vapor generation function of the vapor provision system is activated, a user sucks/inhales on the mouthpiece to draw air through the device. Air is drawn from the environment into the device and at least a portion of this air enters the vaporization chamber of the cartomizer. Accordingly, the incoming air flows past the heater in the vaporization chamber while the heater is receiving electrical power from the battery in the control unit so as to generate a vapor from the relevant vapor precursor material in the vaporization chamber. The vaporized material is then incorporated/entrained into the airflow and drawn through and out of the relevant cartomizer for inhalation by a user. FIGS. 1, 2 and 3 include an arrow to indicate the general direction of airflow through and out of the cartomizer for inhalation by a user.

When in a hybrid device, the vaporized material will typically contact and/or pass through the substrate material, e.g. a tobacco material, downstream of the vaporizer before inhalation of the vapor by a user. The substrate material may be located in the cartomizer (e.g. in the vaporization chamber thereof) or in an air flow path from the outlet of the cartomizer to the mouthpiece or other outlet of the device. The latter may involve the substrate material being in a separate chamber or container which forms part of the airflow path. The person skilled in the art will be aware of suitable configurations for a hybrid device.

The vapor may be produced or released in various ways depending on the nature of the device, system or product. These include heating to cause evaporation, heating to release compounds, and vibration of a liquid or gel to create droplets.

During normal use, the control circuitry may be configured to monitor various operational aspects of the vapor provision system. For example, the control circuitry may be configured to monitor a level of power remaining in the rechargeable battery, and this may be performed in accordance with conventional techniques.

Additionally the control circuitry may be configured to estimate a remaining amount of vapor precursor material in the cartomizer, for example based on an accumulated time of usage since a new cartomizer was installed, or based on sensing the levels in the cartomizer. This may be performed in accordance with any conventional technique(s). The control circuitry may also be configured to estimate a remaining time for the substrate material in a hybrid device, for example, based on an accumulated time of usage since a new substrate material and/or cartomizer was installed, or based on sensing the number of puffs on the device. This may be performed in accordance with any conventional technique(s).

If it is determined through monitoring the operational aspects of the vapor provision system that a certain operating condition has arisen, for example, a cartomizer and/or substrate material is approaching depletion, or a battery level is falling below a predetermined threshold (which may be predefined or user set), the vapor provision system may be configured to provide a user notification according to any conventional technique(s). Although described with reference to the control circuitry, other user notifications are known in the art and may be implemented in the vapor provision system of the invention. In addition, it will be appreciated that there are many other situations in which a user notification might be desired, the invention is not limited to providing notification of low levels of liquid or substrate material or remaining battery power.

In accordance with the present invention, however, user notification via the control circuitry or otherwise is not necessary if an "end-of-life" operating condition has arisen. By the term "end-of-life" is meant that the cartomizer and/or substrate material is approaching depletion such that the vapor provision system is in the end of its useful life from the point of view of the user or consumer. In other words, the cartomizer and/or substrate material are approaching the point in time when they need to be replaced.

User notification of an "end-of-life" operating condition is provided by the first and second vapor precursor materials respectively having a first and second flavor characteristic, where the second flavor characteristic is different from the first flavor characteristic, and where the first and second vapor precursor materials are configured to form an inhomogeneous mixture in the reservoir of the cartomizer. The user notification is provided by an "end-of-life" flavor arising from the vaporization of the second vapor precursor material.

In one embodiment, the second flavor characteristic of the second vapor precursor material is a tobacco flavor. The use of a tobacco flavor for the second vapor precursor material advantageously provides an end-of-life flavor which extends the useful life of a product whilst simultaneously providing a user notification. The extension of life by a tobacco flavor is particularly advantageous for a hybrid device comprising a cartomizer of the invention and a substrate which is tobacco.

For example, the first vapor precursor material may have a flavor characteristic for normal use and when substantially all of the first vapor precursor material has been vaporized, the second vapor precursor material is vaporized. This is the situation shown in FIG. 2. The second flavor characteristic of the second vapor precursor material is then sensed by the user and interpreted as a user notification. The change in flavor characteristic can be used to indicate, for example, that the cartomizer needs replacing. The relative amounts of the first and second vapor precursor materials can, for instance, also be adjusted so that the user knows how many puffs they have left before the cartomizer is completely depleted.

In one embodiment the second vapor precursor material is included in an amount which equates to about 10 to about 20 puffs of the vapor provision system. On sensing the second flavor characteristic of the second vapor precursor material, the user knows that they have about 10 about 20 puffs before the cartomizer must be replaced or refilled. Depending on the size of the reservoir, the skilled person will be able to calculate the appropriate amount of the second vapor precursor material to deliver about 10 to about 20 puffs. For example, if the reservoir is approximately 2 ml in size and delivers approximately 166 puffs in total, the second vapor precursor material will be included at an amount of approximately 0.24 ml to deliver 20 puffs to the user.

When used in a hybrid device, the first vapor precursor material may have a flavor characteristic for normal use and be included in amount which corresponds to the number of puffs associated with the life of the substrate. For example, if the substrate is a tobacco material and included in an amount of which corresponds to approximately 160 puffs in normal use, the first vapor precursor material can included in an amount also corresponding to approximately 160 puffs in normal use. This means that when substantially all of the first vapor precursor material has been vaporized, the vaporization of the second vapor precursor material will substantially coincide with the exhaustion of the tobacco material. The second flavor characteristic can then either be a flavor which, when sensed by the user, indicates that the substrate and cartomizer need replacing and/or a tobacco flavor to avoid the loss of flavor on exhaustion of the substrate.

Alternatively the second flavor characteristic of the second vapor precursor material can be used to provide additional flavors to a user, not necessarily associated with a user notification.

Thus, in accordance with certain embodiments, a cartomizer and a vapor provision system is provided which generates end-of-life feedback for a user without relying on control circuitry or multiple cartridges/cartomizers. Not only does this obviate the need for a separate status light indicator or complex device design/manufacture, but it can provide the user with notification without the user needing to maintain visual focus on a light indicator. This can help provide the user with end-of-life notifications in situations where an illuminating light would not be desired.

The vapor provision system may also be configured to provide a user notification by changing flavor based on a determined amount of use. For example, if the cartomizer included three or more vapor precursor materials, it may be configured to generate vapor from the second precursor material having the second flavor characteristic after a given amount of vapor has been generated from the first vapor precursor material. This would be achieved by aligning the amount of first vapor precursor material with a number of puffs. The second vapor precursor material would then indicate to the user that they have inhaled an amount of e.g. nicotine from the first vapor precursor material, and only after the second vapor precursor material had been vaporized would the third vapor precursor material having a third flavor characteristic be sensed by the user. This third vapor precursor material could, for example, have the same or different flavor characteristic to the first vapor precursor material but would have a flavor characteristic which differed from the second flavor characteristic. Further vapor precursor materials with defined flavor characteristics could also be included to provide an end-of-life notification to the user.

In accordance with the invention, all of the vapor precursor materials would be configured to form an inhomogeneous mixture.

This and other aspects of the vapor precursor material will now be discussed in more detail.

Vapor Precursor Material

The present disclosure relates to a first vapor precursor material 3 having a first flavor characteristic, and a second vapor precursor material 2 having a second flavor characteristic. It will, however, be appreciated by the person skilled in the art that the present disclosure is not limited to two such vapor precursor materials. For example, the invention can include a third vapor precursor material having a third flavor characteristic, where the third vapor precursor material is configured to form an inhomogeneous mixture with the first and second vapor precursor materials, and where the third flavor characteristic is different from at least the second flavor characteristic. The invention can also include further vapor precursor materials with defined flavor characteristics.

In this respect, all of the features discussed for the first and second vapor precursor materials are applicable to further vapor precursor materials included in the invention.

By the term "vapor precursor material" is meant any substance which when brought into the vicinity of a vaporizer, forms a vapor or aerosol. The vapor precursor material can be a material which is known in the art.

The vapor precursor materials of the invention are configured to form an inhomogeneous mixture. In this regard, any means of forming an inhomogeneous mixture of two or more substances may be used. Such means are known by the person skilled in the art.

In one embodiment the vapor precursor materials form an inhomogeneous mixture because they are immiscible. By the term "immiscible" is meant a liquid which cannot be mixed with another liquid without separating from it. Oil is, for example, immiscible with or in water.

In a further embodiment, the second vapor precursor material is less dense than the first vapor precursor material.

The cartomizer example shown in FIGS. 1, 2 and 3 is where a first vapor precursor material 3 and a second vapor precursor material 2 are immiscible and where the second vapor precursor material is less dense than the first vapor precursor material. Because of their immiscibility and relative densities, the second vapor precursor material 2 sits atop the first vapor precursor material 3 within the reservoir of the cartomizer. This arrangement, together with for example, the position of the vaporizer (here a wick 4 and a coil 5) and/or the amount of each vapor precursor material in the reservoir, allows the order and timing of vaporization of each vapor precursor material to be controlled without user involvement.

For example, when in use, a vapor provision system containing a cartomizer shown in FIG. 1 will vaporize the first vapor precursor material providing vapor with a first flavor characteristic. Once the level of the first vapor precursor material is depleted by an amount which brings the second vapor precursor material into contact with the wick, such as the arrangement shown in FIG. 2, the second vapor precursor material will be vaporized to form a vapor with a second flavor characteristic. The skilled person will appreciate that if the vaporizer (e.g. wick and coil) is located at a higher position within the reservoir, less of the first vapor precursor material will need to vaporize before the second vapor precursor material is vaporized. The skilled person will also appreciate that if the first vapor precursor material amounts to e.g. about 90 to about 95 wt % of the total material in the reservoir and the second vapor precursor material amounts to e.g. about 5 to about 10 wt % of the total material in the reservoir, the user will only experience the flavor characteristic of the second vapor precursor material towards the end of the life of the cartomizer.

As well as the configuration of the vaporizer and vapor precursor materials, other means of controlling the order of vaporization can be used. For example when the cartomizer includes a single vaporizer which is a wick and coil, different wicking rates of the first and second vapor precursor material can be used to ensure vaporization of the first vapor precursor material preferentially over the second vapor precursor material.

In one embodiment the second vapor precursor material is configured to provide vapor after at least a portion of the first vapor precursor material has been vaporized. In one embodiment the second vapor precursor material is configured to provide vapor after substantially all of the first vapor precursor material has been vaporized.

By the term "substantially all" is meant at least about 90%.

In one embodiment the second vapor precursor material is configured to provide vapor after at least about 80% of the first vapor precursor material has been vaporized. In one embodiment the second vapor precursor material is configured to provide vapor after at least about 85% of the first vapor precursor material has been vaporized. In one embodiment the second vapor precursor material is configured to provide vapor after at least about 90% of the first vapor precursor material has been vaporized. In one embodiment the second vapor precursor material is configured to provide vapor after at least about 95% of the first vapor precursor material has been vaporized. In one embodiment the second vapor precursor material is configured to provide vapor after at least about 96% of the first vapor precursor material has been vaporized. In one embodiment the second vapor precursor material is configured to provide vapor after at least about 97% of the first vapor precursor material has been vaporized. In one embodiment the second vapor precursor material is configured to provide vapor after at least about 98% of the first vapor precursor material has been vaporized. In one embodiment the second vapor precursor material is configured to provide vapor after at least about 99% of the first vapor precursor material has been vaporized.

In one embodiment the second vapor precursor material amounts to about 1 to about 30 wt % of the total material in the reservoir. In one embodiment the second vapor precursor material amounts to about 2 to about 25 wt % of the total material in the reservoir. In one embodiment the second vapor precursor material amounts to about 3 to about 20 wt % of the total material in the reservoir. In one embodiment the second vapor precursor material amounts to about 4 to about 15 wt % of the total material in the reservoir. In one embodiment the second vapor precursor material amounts to about 5 to about 10 wt % of the total material in the reservoir.

As the skilled person will appreciate the amount of second vapor precursor material in the reservoir can be combined with the amount of first vapor precursor material that must be vaporized before the second vapor precursor material is vaporized. For example, in one embodiment the second vapor precursor material amounts to about 1 to about 30 wt % of the total material in the reservoir and is configured to provide vapor after at least about 85 wt % of the first vapor precursor material has been vaporized. In another embodiment the second vapor precursor material amounts to about 4 to about 15 wt % of the total material in the reservoir and is configured to provide vapor after at least about 90 wt % of the first vapor precursor material has been vaporized.

From the description herein, the skilled person will appreciate that whilst the order and timing of vapor being generated from each of the first and second vapor precursor material does not require user involvement, if a user were to invert the cartridge/cartomizer so that the first vapor precursor material sat atop the second vapor precursor material, vapor from the second vapor precursor material having the second flavor characteristic would be produced. The cartomizer of the invention does not therefore require user involvement, but advantageously allows a user to change the flavor characteristic of the vapor being produced, if so desired.

In one embodiment the second vapor precursor material is therefore configured to provide vapor with the second flavor characteristic in response to a user action on the vapor provision system comprising the cartomizer as disclosed herein.

When the vapor precursor materials are immiscible, they can comprise an aqueous solution and an oil solution. For example, the first vapor precursor material can be aqueous and the second vapor precursor material can comprise an oil. Alternatively, the first vapor precursor material can comprise an oil and the second vapor precursor material can be aqueous. Alternatively, other immiscible liquids known in the art can be used as the first and second vapor precursor materials respectively. The present disclosure is not limited to an oil/water system.

By the term "aqueous" is meant an aqueous solution or a solution in which the solvent is water. In one embodiment the aqueous solution comprises water and one or more compounds selected from propylene glycol, glycerol, 1,3-propanediol and mixtures thereof. In one embodiment the aqueous solution comprises water and at least one of propylene glycol and glycerol. In one embodiment the aqueous solution comprises water, propylene glycol and glycerol.

For example, the first vapor precursor material may comprise water and one or more compounds selected from propylene glycol, glycerol, 1,3-propanediol and mixtures thereof. In one embodiment the first vapor precursor material comprises water and at least one of propylene glycol and glycerol.

In another embodiment the aqueous solution comprises one or more compounds selected from propylene glycol, glycerol, 1,3-propanediol and mixtures thereof. In one embodiment the aqueous solution comprises at least one of propylene glycol and glycerol. For example, the first vapor precursor material may comprise one or more compounds selected from propylene glycol, glycerol, 1,3-propanediol and mixtures thereof. In one embodiment the first vapor precursor material comprises at least one of propylene glycol and glycerol.

By the term "oil" is meant a hydrophobic and nonpolar chemical substance that is a liquid at ambient temperatures, non-volatile and lipophilic. The oil may be animal or vegetable in origin. The skilled person would appreciate what oils are suitable for use in a vapor provision system such as described herein. In one embodiment the oil is a low molecular weight oil. By the term "low molecular weight" is meant a molecular weight low enough for the oil to be atomized within the vapor provision system. Again, the skilled person will be aware of materials which fall within this definition. In one embodiment the oil is triacetin.

In one embodiment the second vapor precursor material is an oil as defined above.

In another embodiment the vapor precursor materials form an inhomogeneous mixture because they are different states of matter; for instance, the first vapor precursor material can be a different state of matter to the second vapor precursor material. For example, the first vapor precursor material can be a liquid or a gel and the second vapor precursor material can be a solid, or vice versa. Alternatively, the first vapor precursor material can be a liquid and the second vapor precursor material can be a solid or a gel, or vice versa.

This is the situation shown in FIG. 3: the first vapor precursor material is a liquid and the second vapor precursor material is a solid.

In one embodiment the second vapor precursor material is a solid or a gel. When the second vapor precursor material is a solid or a gel, it can have a melting temperature which is below the operating temperature of the vapor provision system in which the cartomizer is used.

In one embodiment the second vapor precursor material is a solid or a gel having a melting temperature below about 200° C. In another embodiment the second vapor precursor material is a solid or a gel having a melting temperature below about 190° C. In another embodiment the second vapor precursor material is a solid or a gel having a melting temperature below about 180° C. In another embodiment the second vapor precursor material is a solid or a gel having a melting temperature below about 170° C. In another embodiment the second vapor precursor material is a solid or a gel having a melting temperature below about 160° C. In another embodiment the second vapor precursor material is a solid or a gel having a melting temperature below about 150° C. In another embodiment the second vapor precursor material is a solid or a gel having a melting temperature below about 140° C. In another embodiment the second vapor precursor material is a solid or a gel having a melting temperature below about 130° C. In another embodiment the second vapor precursor material is a solid or a gel having a melting temperature below about 120° C. In another embodiment the second vapor precursor material is a solid or gel having a melting temperature below about 100° C.

In one embodiment the first vapor precursor material is an aqueous solution and the second vapor precursor material is a solid or a gel, preferably a solid having a melting temperature as defined above.

With a solid or gel second precursor material, the first vapor precursor material may be an aqueous solution comprising water and one or more compounds selected from propylene glycol, glycerol, 1,3-propanediol and mixtures thereof. In one embodiment the aqueous solution comprises water and at least one of propylene glycol and glycerol. In one embodiment the aqueous solution comprises water, propylene glycol and glycerol.

In one embodiment the first vapor precursor material is an aqueous gel and the second vapor precursor material is a solid, preferably a solid having a melting temperature as defined above.

Without wishing to be bound by any one theory, the inventors believe that by using a solid or a gel with a melting temperature below the operating temperature of the vapor provision system, it is possible for the second vapor precursor material to only be vaporized after substantially all of the first vapor precursor material has been vaporized. This is because it is only after substantially all of the first vapor precursor material has been vaporized that the second vapor precursor material comes into the vicinity of the vaporizer and undergoes a phase transition to a liquid so that it can be vaporized.

When the second vapor precursor material is a solid, it may be in any form suitable for incorporation into the reservoir of the cartomizer. The second vapor precursor material may, for example, be in the form of beads, granules, powder, a tablet, or the like. When in the form of a powder, the second vapor precursor material may be loaded onto a substrate and the combination of the substrate and powder are preferably less dense than the first vapor precursor material such that the vaporization of the second vapor precursor material and optionally the substrate, takes place after at least partial vaporization of the first vapor precursor material.

The substrate for the second vapor precursor material may also be vaporizable, and may have a melting temperature which is higher or lower than that of the second vapor precursor material. When the melting temperature of the second vapor precursor material is lower than the substrate, the second vapor precursor material should liquefy and then vaporize before the substrate and thereby deliver the second flavor characteristic to the user following vaporization of substantially all of the first vapor precursor material. When the melting temperature of the substrate is lower than the melting temperature of the second vapor precursor material, the substrate should liquefy before the second vapor precursor material. In this instance, the substrate may be miscible with the first vapor precursor material.

The substrate for the second vapor precursor material is not limited and the skilled person would be readily able to identify a suitable material based on the desired properties and vaporization behavior of the substrate and second vapor precursor material. For example, when it is not desired for the substrate to vaporize, but merely act as a carrier for the second vapor precursor material, it may be a material that can absorb and then subsequently release the second vapor precursor material on application of heat or the like. For example, the substrate may be a plastic film with pores or micro-holes, a sponge-like film, a porous carbon material, a porous ceramic material, a silicon compound such as glass, or a fibrous element. Possible materials therefore include cellulose acetate, polyurethane, vinyl acetate, polycarbonate, carbon, ceramics, silicon compounds (e.g. silica) or mixtures thereof. In various embodiments, the material may be a ceramic material, a carbon material, or a glass.

Alternatively when it is desired for the substrate to vaporize at least partially, it may either have a higher melting temperature than the second vapor precursor material or have a melting temperature equal to or less than the melting temperature of the second vapor precursor material and be miscible with the first vapor precursor material upon liquefying. When the substrate is vaporisable it should not have a significant effect on the flavor characteristic of the second vapor precursor material. The substrate may therefore comprise a material selected from the group consisting of carboxymethyl cellulose, pullulan, hydroxypropylmethyl cellulose, hydroxyethyl cellulose, hydroxypropyl cellulose, polyvinyl pyrrolidone, polyvinyl alcohol, sodium alginate, polyethylene glycol, xanthum gum, tragacanth gum, guar gum, acacia gum, Arabic gum, natural waxes, shea butter, carbowax, polyacrylic acid, methylmethacrylate copolymer, carboxyvinyl polymer, carrageenan, amylose, high amylose starch, hydroxypropylated high amylose starch, dextrin, pectin, chitin, chitosan, levan, elsinan, collagen, gelatin, zein, gluten, soy protein isolate, whey protein isolate, casein and/or mixtures thereof.

In another embodiment, the vapor precursor materials form an inhomogeneous mixture in the reservoir because a layer or barrier is included which separates the first vapor precursor material from the second vapor precursor material. Such a layer or barrier may separate the materials physically or chemically. By "physically or chemically" is meant that the layer may act as a physical barrier between the materials, or the layer may have chemical properties which prevent the materials from forming a homogenous mixture. Regardless of whether the layer physically or chemically separates the materials, the layer should be composed of a material which does not interfere with or have a detrimental effect on the cartomizer or the vapor provision system, when the cartomizer is in use.

For example, the layer may be made of a material which is able to be vaporized by the vaporizer in the cartomizer. In one embodiment, the layer is an oil. It will be appreciated by the skilled person that when the cartomizer includes a layer to separate the vapor precursor materials and form an inhomogeneous mixture, it may be necessary to include a filter in the cartomizer to prevent vaporization and inhalation of the oil by a user. Suitable filters are known in the art.

In various embodiments of the present disclosure, the layer or barrier separating the first and second vapor precursor materials is in the form of a matrix or shell, for example, the second vapor precursor material may be encapsulated in a matrix material or encapsulated with an outer shell. In this capsule arrangement, the second vapor precursor material may be a liquid, gel or solid.

In various embodiments of the present disclosure, the shell or matrix comprising the second vapor precursor material is configured to degrade, rupture or melt in response to an increase in temperature. The increase in temperature is caused by exhaustion of the first vapor precursor material, and the shell or matrix being in contact with or close to the heating element of the cartomizer. For example, the shell or matrix may be partially or completely formed from a material which degrades, ruptures or melts in response to the increase in temperature.

In various embodiments of the present disclosure, the shell or matrix is formed from a material which degrades, ruptures or melts at a temperature of equal to or less than about 100° C. For example a material which has a melting temperature of greater than about 20° C. and equal to or less than about 100° C., such as a material which has a melting temperature of between about 40° C. and about 100° C. Suitable materials are known in the art and may include various waxes, resins and high molecular weight polyethylene glycols or the like.

Without wishing to be bound by theory, the inventors believe that such a capsule arrangement involves the shell or matrix material degrading, rupturing or melting to thereby release the second vapor precursor material. The shell or matrix material may be miscible with the first vapor precursor material and optionally be vaporized with the first vapor precursor material.

The combination of shell or matrix material and second vapor precursor material should be less dense than the first vapor precursor material. With this arrangement, the capsule formed by the shell/matrix and the second vapor precursor material effectively "floats" on the surface of the first vapor precursor material. Upon degradation, rupture or melting of the shell/matrix material, the second vapor precursor material is then released and vaporized. For example, the first vapor precursor material may be a solution comprising propylene glycol, glycerol, 1,3-propanediol or mixtures thereof, and the second vapor precursor material may be an aqueous solution, an ethanol solution or a polyethylene glycol solution.

In particular, the shell/matrix material may comprise a material selected from the group consisting of hydroxypropyl cellulose, high molecular weight polyethylene glycols (e.g. a PEG with a molecular weight greater than 2000 or greater than 2500 such as PEG 3350, PEG 4000, PEG 6000 and the like), natural waxes, shea butter, carbowax, carrageenan, collagen, gelatin, whey protein isolate, casein and/or mixtures thereof. In various embodiments of the present disclosure, the shell/matrix material is selected from the group consisting of polyethylene glycol, natural waxes, shea butter, carbowax carrageenan, or mixtures thereof.

Flavor Characteristic

The vapor precursor materials of the invention have different flavor characteristics. In one embodiment these flavor characteristics can be achieved by including or equally not-including a "flavor", "flavoring agent" or "flavorant" in the vapor precursor material. The terms "flavor", "flavoring agent" and "flavorant" are used interchangeably to refer to materials which, where local regulations permit, are added to the formulation to create a desired taste or aroma in a product for adult consumers. Reference here to "flavor", "flavoring agent" or "flavorant" include both singular and multi-component flavors.

It will, however, be appreciated that the specific nature of the flavors used in accordance with the invention is not necessarily significant. For example, in one embodiment the actual flavors of the vapor precursor materials are not significant and can include each vapor precursor material having the same flavor but at different strengths/levels. What is significant is that a characteristic of the flavor associated with a vapor changes. Thus a change in flavor characteristic may comprise, for example, a change in actual flavor, a change in strength of a flavor, or a change in whether there is any flavor.

In some embodiments, one of the vapor precursor materials may be flavored and the other liquid may not be flavored. For example, in one embodiment the first vapor precursor material does not include a flavor—the first vapor precursor material is a non-flavored vapor precursor material—and the second vapor precursor material includes a flavor. In one embodiment the second vapor precursor material includes a tobacco flavor. In another embodiment the second vapor precursor material includes a non-tobacco flavor.

When a flavor, flavoring agent or flavorant is included in the vapor precursor material(s) to provide a flavor characteristic, this flavor, flavoring agent or flavorant may be selected from the group consisting of extracts, for example liquorice, hydrangea, Japanese white bark magnolia leaf, tobacco, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, pimento, ginger, anise, coriander, coffee, flavor enhancers, bitterness receptor site blockers, sensorial receptor site activators or stimulators, sugars and/or sugar substitutes (e.g. sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In one embodiment the second vapor precursor material includes a flavor which indicates to a user that the cartridge is nearing the end of its life. This indicative flavor could be e.g. menthol, such that when the user inhales vapor with a menthol flavor, they know to replace the cartomizer with a fresh cartomizer.

In another embodiment the second vapor precursor material includes a flavor which extends the life of the vapor provision system as well as providing an indication to a user that the cartridge is nearing the end of it life. This flavor could be e.g. a tobacco flavor.

Other Components

Along with having a certain flavor characteristic, the vapor precursor materials may comprise other components. Such components may be conventional in the sense that they are typically included in vapor precursor materials for e-cigarettes and the like.

In one embodiment the vapor precursor materials further comprise an active agent. By the term "active agent" is meant any agent which has a biological effect on a subject when the vapor is inhaled. The one or more active agents may be selected from nicotine, botanicals, and mixtures thereof. The one or more active agents may be of synthetic or natural origin. The active could be an extract from a botanical, such as from a plant in the tobacco family. An example active is nicotine.

Thus in one embodiment the first vapor precursor material comprises an active agent; preferably the active agent is nicotine. Nicotine may be provided in any suitable amount depending on the desired dosage when inhaled by the user.

In one embodiment nicotine is present in an amount of no greater than about 6 wt % based on the total weight of the vapor precursor material. By the expression "total weight of the vapor precursor material" is meant the total weight of the vapor precursor material in which the nicotine is present, e.g. the first vapor precursor material.

In one embodiment nicotine is present in an amount of from about 0.4 to about 6 wt % based on the total weight of the vapor precursor material. In one embodiment nicotine is present in an amount of from about 0.8 to about 6 wt % based on the total weight of the vapor precursor material. In one embodiment nicotine is present in an amount of from about 1 to about 6 wt % based on the total weight of the vapor precursor material. In one embodiment nicotine is present in an amount of from about 1.8 to about 6 wt % based on the total weight of the vapor precursor material.

In another embodiment nicotine is present in an amount of no greater than about 3 wt % based on the total weight of the vapor precursor material. In one embodiment nicotine is present in an amount of from about 0.4 to about 3 wt % based on the total weight of the vapor precursor material. In one embodiment nicotine is present in an amount of from about 0.8 to about 3 wt % based on the total weight of the vapor precursor material. In one embodiment nicotine is present in an amount of from about 1 to about 3 wt % based on the total weight of the vapor precursor material. In one embodiment nicotine is present in an amount of from about 1.8 to about 3 wt % based on the total weight of the vapor precursor material.

In one embodiment nicotine is present in an amount of less than about 1.9 wt % based on the total weight of the vapor precursor material. In one embodiment nicotine is present in an amount of less than about 1.8 wt % based on the total weight of the vapor precursor material. In one embodiment nicotine is present in an amount of from about 0.4 to less than about 1.9 wt % based on the total weight of the vapor precursor material. In one embodiment nicotine is present in an amount of from about 0.4 to less than about 1.8 wt % based on the total weight of the vapor precursor material. In one embodiment nicotine is present in an amount of from about 0.5 to less than about 1.9 wt % based on the total weight of the vapor precursor material. In one embodiment nicotine is present in an amount of from about 0.5 to less than about 1.8 wt % based on the total weight of the vapor precursor material. In one embodiment nicotine is present in an amount of from about 0.8 to less than about 1.9 wt % based on the total weight of the vapor precursor material. In one embodiment nicotine is present in an amount of from about 0.8 to less than about 1.8 wt % based on the total weight of the vapor precursor material. In one embodiment nicotine is present in an amount of from about 1 to less than about 1.9 wt % based on the total weight of the vapor precursor material. In one embodiment nicotine is present in an amount of from about 1 to less than about 1.8 wt % based on the total weight of the vapor precursor material.

In one embodiment, the vapor precursor material(s) may contain one or acids. In some embodiments, the vapor precursor material(s) may contain one or more acids in addition to nicotine (as the active agent). In some embodiments, the one or more acids may be one or more organic acids. In some embodiments, the one or more acids may be one or more organic acids selected from the group consisting of benzoic acid, levulinic acid, malic acid, maleic acid, fumaric acid, citric acid, lactic acid, acetic acid, succinic acid, and mixtures thereof. When included in the vapor precursor material(s) in combination with nicotine, the one or more acids may provide a formulation in which the nicotine is at least partially in protonated (such as monoprotonated and/or diprotonated) form.

In order to address various issues and advance the art, this disclosure shows by way of illustration, various embodiments in which the claimed invention may be practiced. The advantages and features of the disclosure are of a representative sample of embodiments only, and are not exhaustive and/or exclusive. They are presented only to assist in understanding and to teach the claimed invention.

It is to be understood that advantages, embodiments, examples, functions, features, structures and/or other aspects of the disclosure as defined by the claims or limitations on equivalents to the claims, and that other embodiments may be utilized and modifications may be made without departing from the scope of the claims. Various embodiments may suitable comprise, consist of, or consist essentially of, various combinations of the disclosed elements, components, features, parts, steps, means, etc. other than those specifically described herein.

The invention claimed is:

1. A cartomizer for a vapor provision system configured to selectively generate vapors with different flavor characteristics, wherein the cartomizer comprises:

(i) a reservoir comprising a first vapor precursor material having a first flavor characteristic, and a second vapor precursor material having a second flavor characteristic; and ii) at least one vaporizer for generating vapor from the first vapor precursor material and the second vapor precursor material;

wherein the first vapor precursor material and the second vapor precursor material form an inhomogeneous mixture within the reservoir, because they are immiscible liquids; wherein the first vapor precursor material is in contact with the vaporizer; wherein the first vapor precursor material is configured to provide vapor with the first flavor characteristic; and wherein the second vapor precursor material is configured to provide vapor with the second flavor characteristic, wherein the second flavor characteristic is different from the first flavor characteristic; and wherein the second vapor precursor material is configured to provide vapor after at least a portion of the first vapor precursor material has vaporized.

2. The cartomizer of claim 1, wherein the second vapor precursor material is configured to provide vapor after at least 90% of the first vapor precursor material has been vaporized.

3. The cartomizer of claim 1, wherein the cartomizer comprises a single vaporizer for generating vapor from both the first vapor precursor material and the second vapor precursor material.

4. The cartomizer of claim 3, wherein the second vapor precursor material is less dense than the first vapor precursor material.

5. The cartomizer of claim 1, wherein the first vapor precursor material is aqueous and the second vapor precursor material comprises an oil.

6. The cartomizer of claim 1, wherein the first vapor precursor material comprises at least one of propylene glycol and glycerol, and the second flavor characteristic of the second vapor precursor material comprises a tobacco or non-tobacco flavor.

7. The cartomizer of claim 1, wherein the second vapor precursor material amounts to about 5 to about 10 wt % of the total material in the reservoir.

8. A vapor provision system comprising the cartomizer of claim 1.

9. The vapor provision system of claim 8 further comprising at least one tobacco material, wherein the second flavor characteristic of the second vapor precursor material comprises a tobacco or non-tobacco flavor.

10. The cartomizer of claim 1, wherein the second vapor precursor material is a solid having a melting temperature below about 200° C.

11. Use of a first vapor precursor material and a second vapor precursor material in a vapor provision system, to provide an end-of-life flavor; wherein the first and second vapor precursor materials form an inhomogeneous mixture; wherein the first and second vapor precursor materials are immiscible; wherein the first vapor precursor material is in contact with a vaporizer of the vapor provision system; wherein the first vapor precursor material is configured to provide vapor with a first flavor characteristic; wherein the second vapor precursor material is configured to provide vapor with a second flavor characteristic that is different from the first flavor characteristic; wherein the second vapor precursor material is configured to provide vapor after at least a substantial portion of the first vapor precursor material has been vaporized, and wherein the second flavor characteristic of the second vapor precursor material comprises a tobacco or non-tobacco flavor.

12. A method of operating a vapor provision system configured to selectively generate vapors with different flavor characteristics for inhalation by a user, wherein the method comprises:

generating a vapor from a first vapor precursor material having a first flavor characteristic; and generating a vapor from a second vapor precursor material having a second flavor characteristic that is different from the first flavor characteristic;

wherein the first vapor precursor material and the second vapor precursor material form an inhomogeneous mixture, and wherein the first and second vapor precursor materials are immiscible, wherein the first vapor precursor material is in contact with the vaporizer; and wherein the second vapor precursor material is configured to provide vapor after at least a portion of the first vapor precursor material has been vaporized.

13. A method of operating a vapor provision system configured to selectively generate vapors with different flavor characteristics for inhalation by a user, wherein the method comprises:

generating a vapor from a first vapor precursor material having a first flavor characteristic; and generating a vapor from a second vapor precursor material having a second flavor characteristic that is different from the first flavor characteristic;

wherein the first vapor precursor material and the second vapor precursor material form an inhomogeneous mixture, and wherein the first and second vapor precursor materials are immiscible, wherein the first vapor precursor material is in contact with the vaporizer; and wherein the second vapor precursor material is configured to provide vapor with the second flavor characteristic in response to a user action on the vapor provision system.

* * * * *